US006550083B1

(12) United States Patent
LaMantia

(10) Patent No.: US 6,550,083 B1
(45) Date of Patent: Apr. 22, 2003

(54) CRIB AND PLAYPEN PROTECTIVE COVERING

(76) Inventor: Mark LaMantia, 290 Broadway, Suite 405, Methuen, MA (US) 01844

( * ) Notice: Subject to any disclaimer, the term of this patent is extended or adjusted under 35 U.S.C. 154(b) by 0 days.

(21) Appl. No.: 10/040,705

(22) Filed: Jan. 7, 2002

(51) Int. Cl.[7] ..... A47D 15/00; A47D 13/06
(52) U.S. Cl. ..... 5/97; 5/424; 5/414; 135/96
(58) Field of Search ..... 5/97, 414, 416, 5/424, 93.1, 946; 135/96

(56) References Cited

U.S. PATENT DOCUMENTS

| | | | | |
|---|---|---|---|---|
| 2,128,978 A | | 9/1938 | Akin | |
| 2,566,790 A | | 9/1951 | Bloomfield | |
| 3,165,760 A | * | 1/1965 | Abajian | 5/97 |
| 4,017,917 A | | 4/1977 | Brown | |
| 4,232,415 A | | 11/1980 | Webber | |
| 4,370,765 A | | 2/1983 | Webber | |
| 4,745,936 A | | 5/1988 | Scherer | |
| 4,823,416 A | | 4/1989 | Lampard | |
| 4,862,534 A | * | 9/1989 | Gomez-Marcial | 5/97 |
| 4,945,584 A | | 8/1990 | LaMantia | |
| 5,161,261 A | | 11/1992 | Kamata | |
| 5,511,572 A | | 4/1996 | Carter | |
| 5,517,707 A | * | 5/1996 | LaMantia | 5/97 |
| 5,575,025 A | | 11/1996 | Peters | |
| 5,632,293 A | | 5/1997 | Carter | |
| 5,683,199 A | | 11/1997 | Tehan | |
| 5,685,076 A | | 11/1997 | Curley et al. | |
| 5,836,330 A | | 11/1998 | Franklin | |
| 5,881,408 A | | 3/1999 | Bashista et al. | |
| 5,916,828 A | | 6/1999 | Messner | |
| 5,921,260 A | | 7/1999 | Carter | |
| 5,930,854 A | | 8/1999 | O'Neill et al. | |
| 6,076,312 A | | 6/2000 | Carter | |
| 6,119,288 A | | 9/2000 | Hendrickson | |
| 6,123,091 A | * | 9/2000 | Flynn et al. | 135/96 |
| 6,131,127 A | | 10/2000 | Gafken et al. | |
| 6,131,217 A | | 10/2000 | Kasem | |
| 6,138,702 A | | 10/2000 | Carter | |
| 6,192,535 B1 | | 2/2001 | Warner, Jr. et al. | |
| 6,216,291 B1 | | 4/2001 | Eads et al. | |
| 6,240,940 B1 | | 6/2001 | Carter | |
| 6,263,894 B1 | * | 7/2001 | LaMantia | 135/96 |

FOREIGN PATENT DOCUMENTS

| | | |
|---|---|---|
| AU | D139199 | 12/1999 |
| AU | D141060 | 7/2000 |
| AU | D142055 | 10/2000 |

* cited by examiner

*Primary Examiner*—Michael F. Trettel
(74) *Attorney, Agent, or Firm*—Wolf, Greenfield & Sacks, P.C.

(57) ABSTRACT

An enclosure for a crib or playpen includes a dome-shaped top and a box-shaped bottom structure for completely enclosing the interior of a crib or playpen. The enclosure includes a flap in the dome-shaped top to allowing a parent or guardian to easily place a child in or remove a child from the crib or playpen. The enclosure also has features which prevent a child from opening the flap.

41 Claims, 6 Drawing Sheets

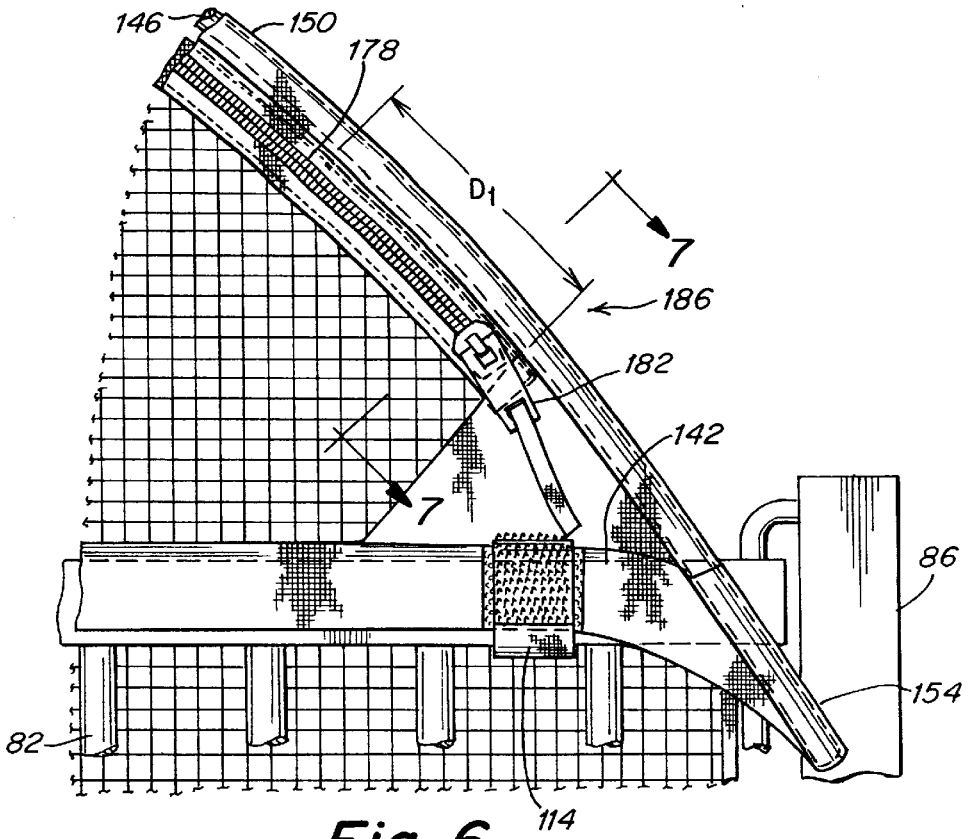
Fig. 6
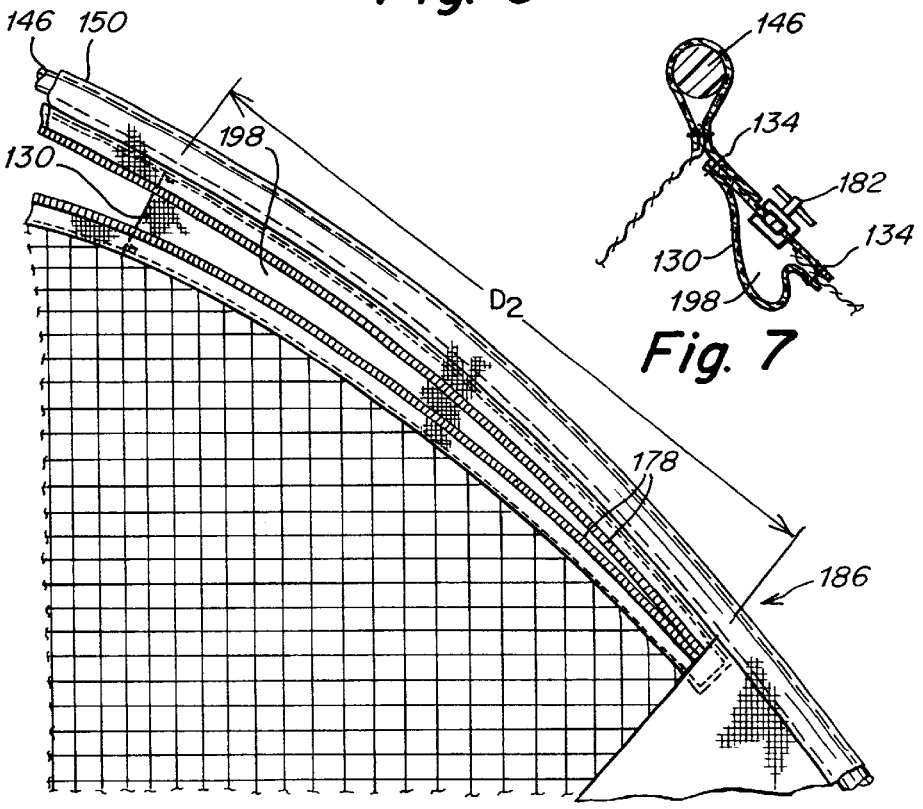
Fig. 7
Fig. 8

CRIB AND PLAYPEN PROTECTIVE COVERING

FIELD OF THE INVENTION

This invention relates to a protective enclosure for cribs and playpens. In particular, it relates to an enclosure primarily comprising a mesh fabric that completely encloses the interior of a crib or playpen.

BACKGROUND OF THE INVENTION

Cribs and playpens are frequently used to retain a child for relatively long periods of time while the child is either sleeping or awake and playing. Cribs are often used to minimize the amount of direct supervision a parent or guardian needs to give to a child by limiting the freedom of movement of the child. It is essential that during these times of limited supervision, potential dangers be minimized without impairing access of the parent or guardian to the child, should it be needed. It should be noted that the terms crib and playpen are used interchangeably herein.

Cribs are often constructed in a box-like fashion with opposed solid headboards and footboards, opposed slatted side rails, and a solid bottom support. However, cribs and playpens do exist that have slatted head and footboards and non-solid bottoms. It is noted that the terms pad and mattress are used interchangeably herein. A snug fitting mattress or pad is typically placed on top of the bottom support. The slatted side rails have openings between the slats through which a child can extend its arms or legs. Additionally, most cribs lack a top covering.

Openings associated with slatted side rails and open crib tops create safety problems. First, older children can climb out the top of open cribs and playpens, subjecting them to possible injury from falls or they may wander into other areas of the house and be exposed to other dangers. A child may extend an arm or leg outside of a crib through the slats and suffer injury such as a fracture. Also, the child may simply have difficulty drawing its arm or leg back into the crib and become chilled because the limb is uncovered. Pets have also been known to gain access to the interior of cribs and playpens through such openings and inflict harm to a child.

SUMMARY OF THE INVENTION

It is an object of this invention to provide a mesh enclosure to safely enclose the interior of a crib or playpen.

One important object of this invention is to provide an enclosure that safely confines a child within a crib and facilitates moving a child in or out of the crib.

Another object of this invention is to provide an enclosure to safely line the interior surface of a crib or playpen and provide a protective structure that covers the top thereof.

The invention comprises an enclosure for a crib or playpen having a headboard, a footboard, side rails, a bottom support and a pad or a mattress. The enclosure has a box-shaped body made of a flexible mesh fabric having a bottom panel, side panels, end panels and a dome-shaped top comprised of a plurality of bowed ribs for supporting a top netting in the form of a tent. The box shaped body of the enclosure fits over the top of the bottom support and inside the headboard, footboard and side rails of a crib. The top netting is connected to the box shaped body and serves to create a completely enclosed area inside of the crib. The top netting includes a flap with a zippered fastener that children cannot access easily from the inside of the enclosure. The zippered fastener is difficult to access because of its position on the top and in some embodiments by the presence of a taut zipper liner or alternatively a zipper pocket on the interior side of the flap near the closed end of the zipper. The opening and the fastener also have the beneficial feature of being placed at an appropriate height for adults and are further arranged for ergonomic use. The fastener opens from right to left, which makes it easier for most adults to open while holding a child.

The invention also includes features for safely securing the enclosure to the structure of the crib. These features include the bottom panel which is held in place by the mattress or pad of the crib or playpen. They may also include end panel straps arranged to hold the enclosure to the footboard and headboard of the crib and side rail straps designed to attach it to the top of the crib side rails.

These and other objects and features of the present invention will be better understood and appreciated from a reading of the following detailed description of an embodiment thereof shown in the accompanying drawings.

BRIEF DESCRIPTION OF THE DRAWINGS

FIG. 6 is an enlarged exterior view taken along sight line 6 in FIG. 2 showing a zipper pocket with the zipper mechanism in the closed position.

FIG. 7 is a cross-sectional view of the zipper pocket taken along section lines 7—7 in FIG. 6.

FIG. 8 is an enlarged exterior view taken along sight line 6 in FIG. 2 showing another embodiment of the zipper pocket with the zipper mechanism in an open position.

DETAILED DESCRIPTION

Figure 1:
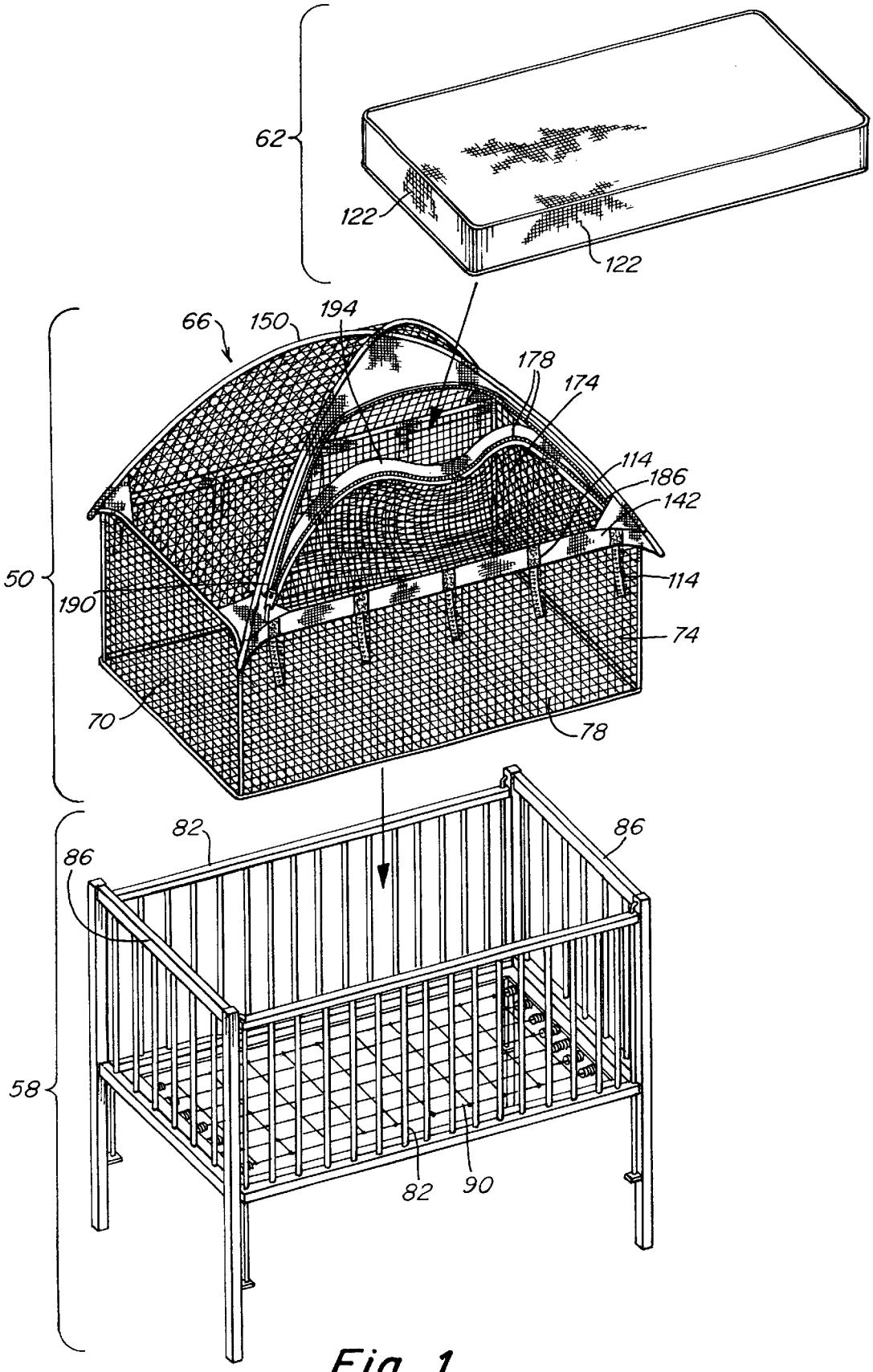
FIG. 1 is an exploded perspective view of one embodiment of the protective enclosure, along with a crib and mattress with which it may be used.

The protective crib enclosure 50 of the present invention is designed to fit in the interior of a crib 58. Its base dimensions are sized to be consistent with the length and width of the bottom pad 62 typically used in cribs 58. The enclosure 50 is comprised of a dome-shaped top 66, two opposed end panels 70, two opposed side panels 74 and a bottom panel 78. The panels 70, 74, 78 and the top 66 are attached to the various components of the crib 58, including side rails 82, headboard and footboard 86, and bottom support 90. Both the end panels 70 and the side panels 74 are designed to be roughly the same height as the interior of a standard crib 58. The dome shaped top 66 of the enclosure 50 is set at a height that will allow a young child to stand unobstructed inside the crib 58.

Figure 2:
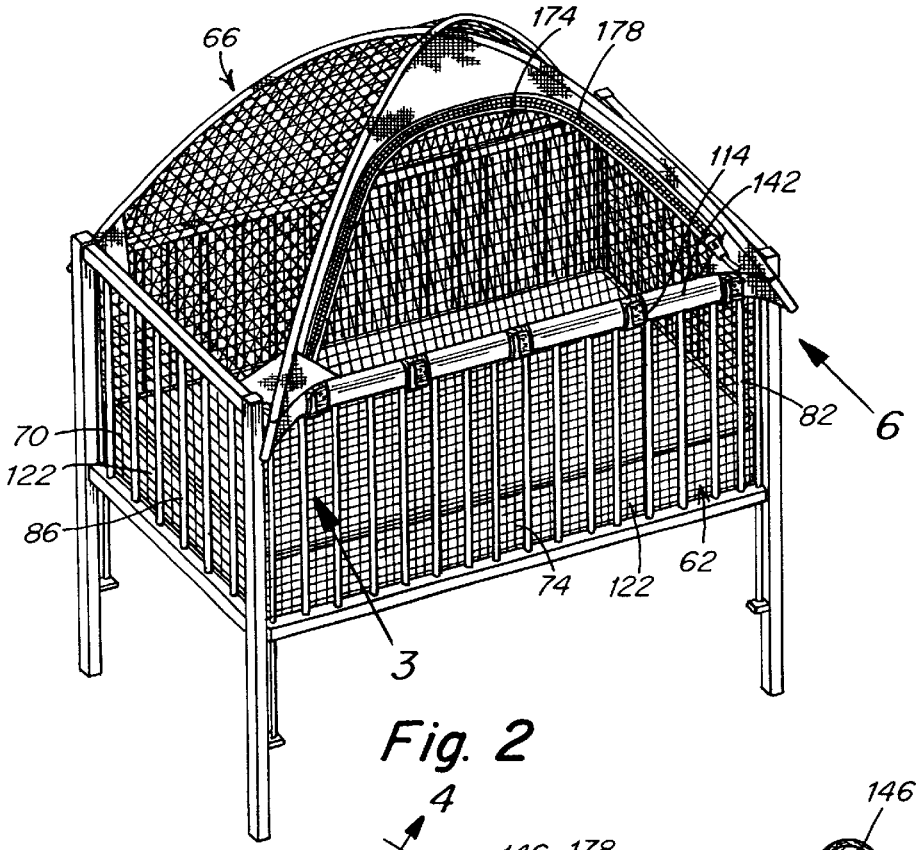
FIG. 2 is a perspective view of the embodiment of FIG. 1 mounted in a crib and with the flap in a closed position.
Figure 9:
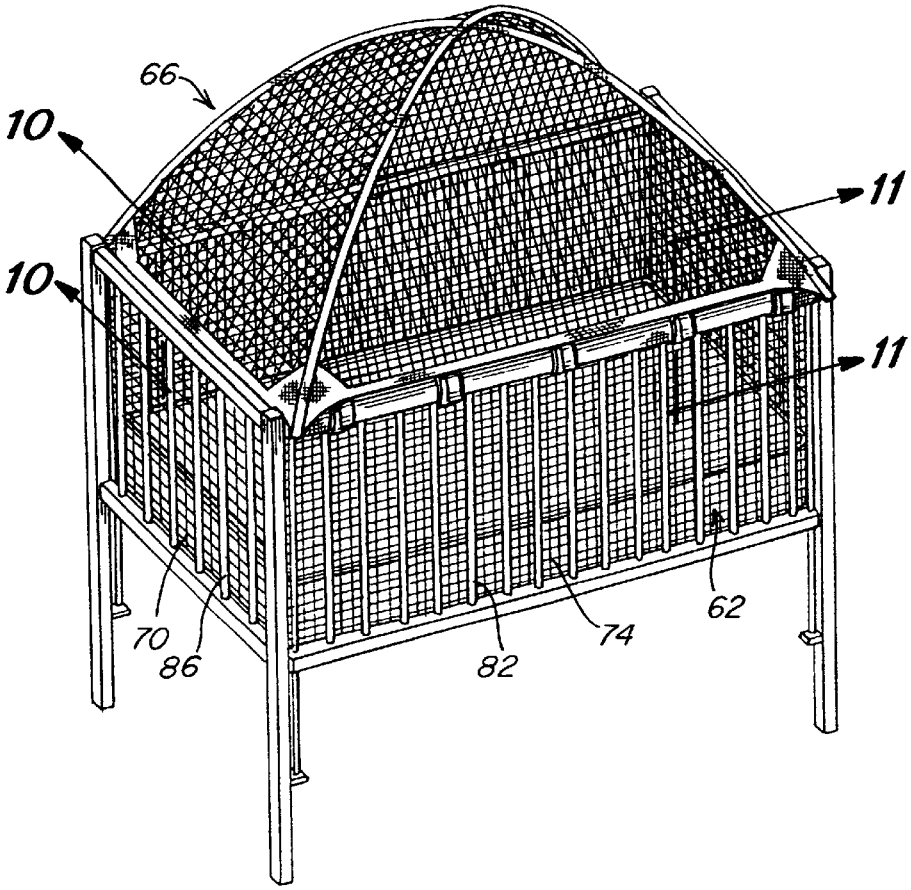
FIG. 9 is a perspective view of the backside of yet another embodiment of the protective enclosure mounted in a crib.
Figure 10:
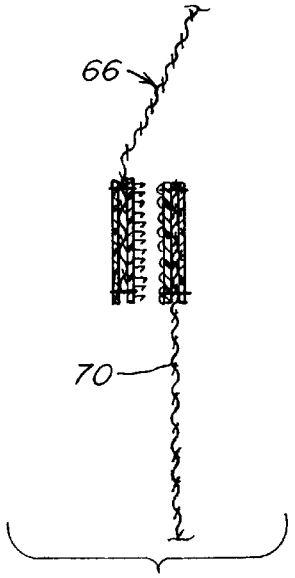
FIG. 10 is a cross sectional view taken along section line 10—10 in FIG. 9 showing one type of connection that may be used between end panels and top.
Figure 11:
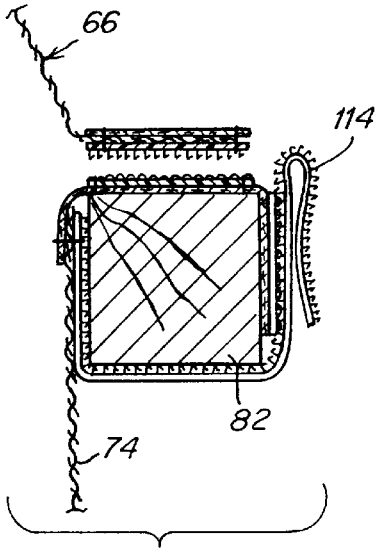
FIG. 11 is a cross sectional view taken along section line 11—11 in FIG. 9 showing one connection embodiment that may be used between the top, the side panels and the side rails.
Figure 12:
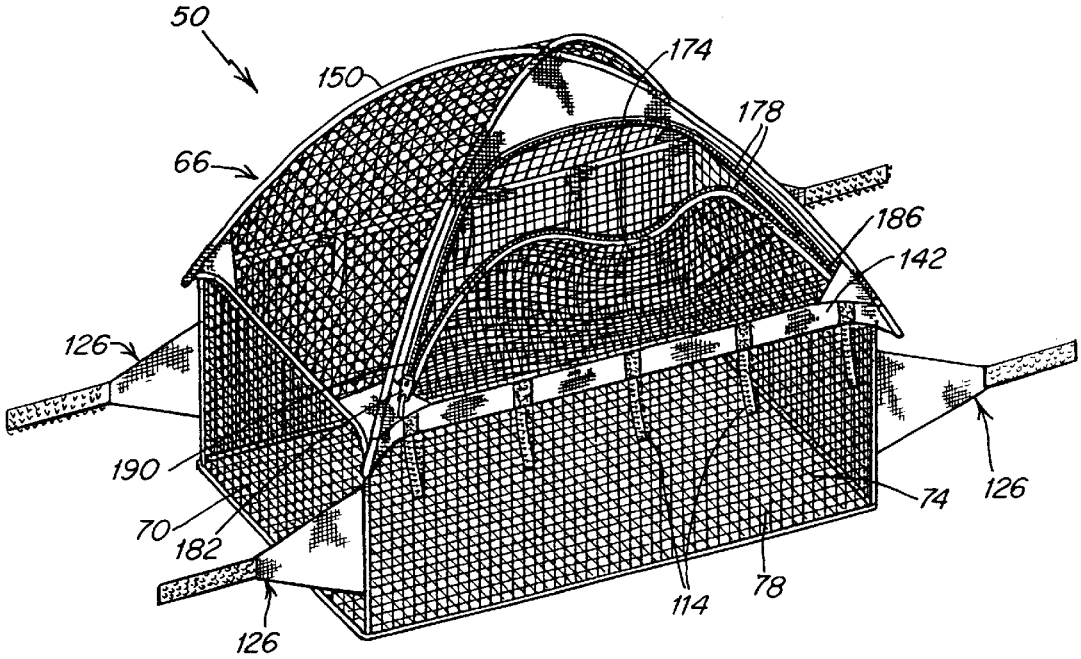
FIG. 12. is a perspective view of one more embodiment of the protective enclosure showing the end panel straps and the flap in an open position.
Figure 13:
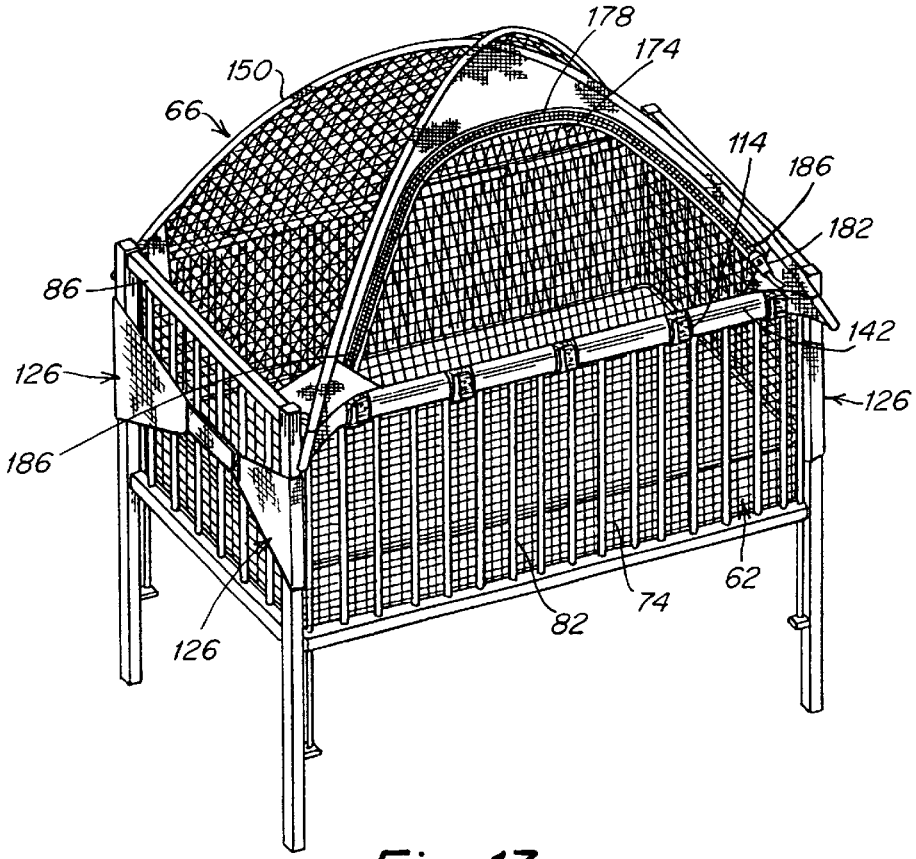
FIG. 13. is a perspective view of the embodiment of FIG. 12 mounted in a crib with the end panel straps and side rail straps secured.
Figure 14:
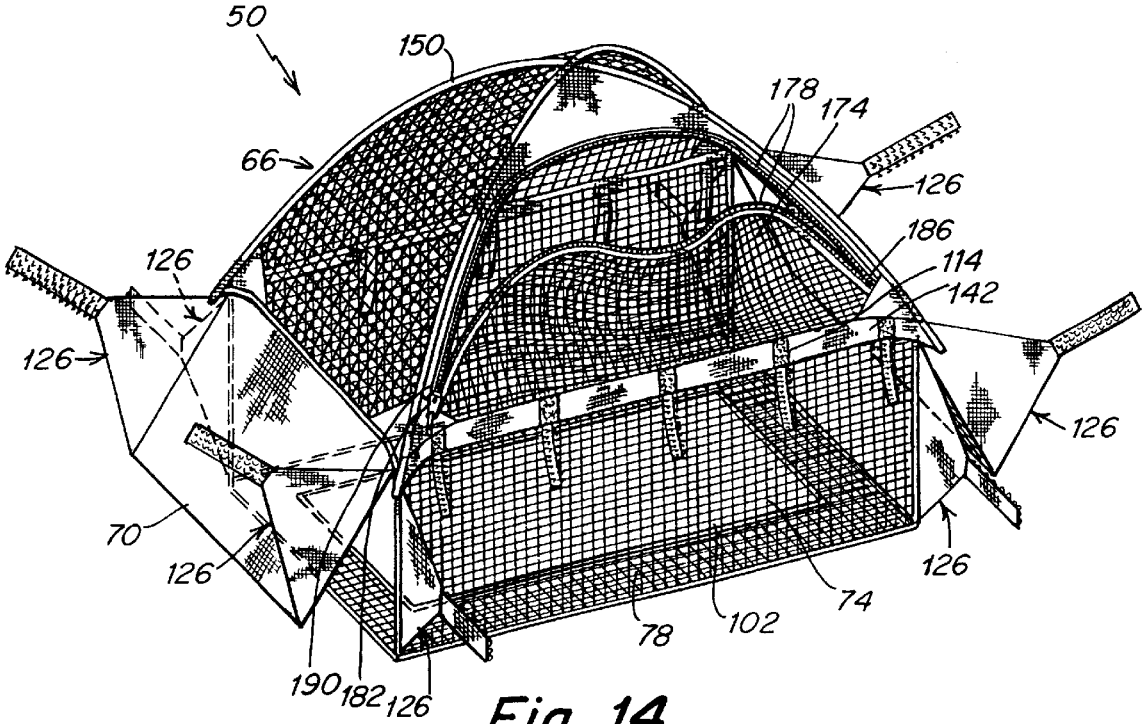
FIG. 14 is a perspective view of yet another embodiment of the protective enclosure showing end panels and side panels that are not directly connected and that have multiple end panel straps.
Figure 15:
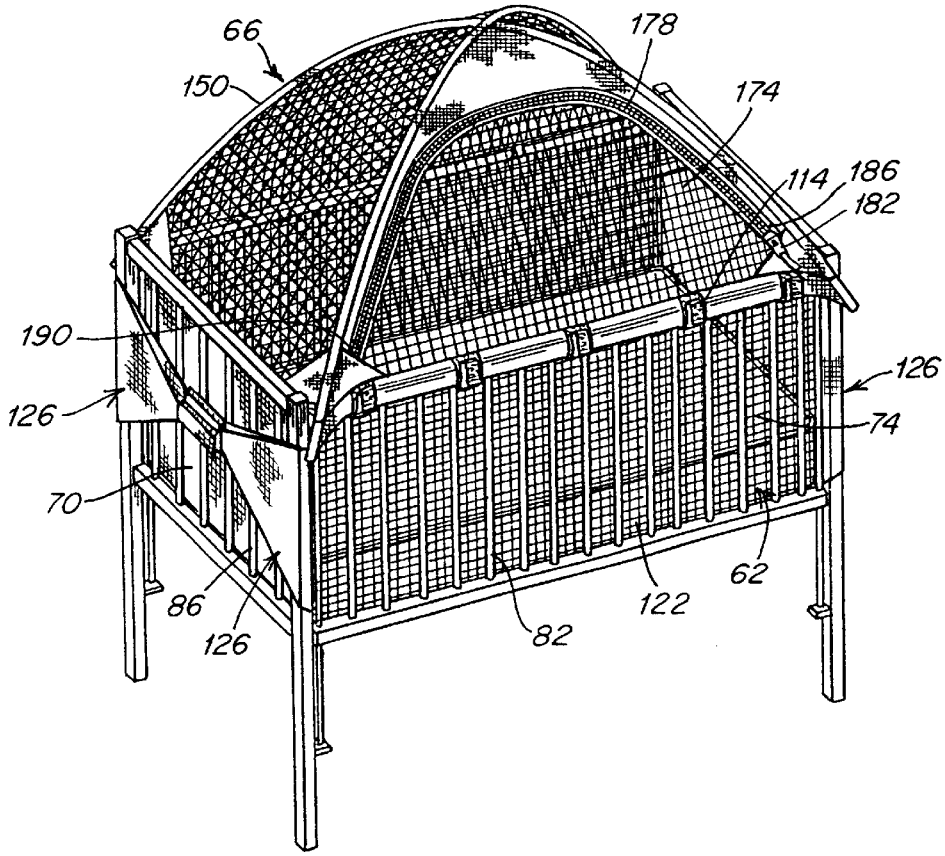
FIG. 15 is a perspective view of the embodiment of FIG. 14 mounted in a crib.

The protective enclosure 50 confines a child to the inside of the crib 58. This is accomplished by lining the interior surfaces of the crib with the box-shaped body of the enclosure and by covering the top of the crib with the dome-shaped top. However, a flap 174 does exist that can be selectively opened, as shown in FIGS. 1, 12, and 14 or closed as shown in FIGS. 2, 13, and 15. Additionally, the bottom panel 78 may only extend under a margin of the pad 62, thus creating an opening 102 to reduce the amount of material required, as shown in FIG. 14. However, in such embodiments the mattress or pad 62 will cover the opening in the bottom panel when the enclosure 50 is installed in a crib 58 as shown in FIGS. 2, 9, 13, and 15. Some embodiments of the enclosure may not have panels that are permanently connected on all of their adjacent edges. One such non-permanent connection is shown in FIGS. 10, and 11 where a VELCRO type (hook and loop) material is used to connect the box-shaped body to the dome-shaped top of the enclosure. FIG. 14 shows yet another embodiment where the end panels 70 and the side panels 74 are not directly connected to one another. However, the end panels and side panels are held tightly against one another when the embodiment shown in FIG. 14 is installed in the crib as shown in FIG. 15. This prevents a child from placing its arms or legs outside of the crib or otherwise becoming entangled at the intersection between the end panels 70 and the side panels 74. While the idea of the invention is to completely enclose the interior 54 of the crib 58, the flap 174 may be left open for children that are too small to stand or otherwise reach the top of the enclosure 50.

The structure of the enclosure 50 is generally comprised of mesh cloth. Although in some embodiments, portions of the covering may be layered with a solid, reinforcing fabric such as a taffeta lining or be replaced with such fabric. For example, this may be done at such locations as the end panels 70 as shown in FIG. 14, end panel straps 126, and side rail straps 1 14 or at the reinforcement strips 142 adjacent the top of the side rails 82, as shown in FIGS. 12 and 13. Other portions of the enclosure 50 may also be reinforced.

Before installing the enclosure 50, the pad 62 is removed from the crib. The enclosure is then placed inside the interior of the crib 58. The pad 62 is inserted through the opening created by the flap 174 and then laid on top of the bottom panel 74 to hold it in position. The side panels 74 and end panels 70 are designed to fit snugly around the sides 122 of the pad 62 to prevent an infant or sundry items in the crib 58 from being lodged between the pad 62 and the side/end panels 70, 74 of the enclosure 50. End panel straps 126 that help attach the enclosure 50 to the crib can be connected to the enclosure 50 near the intersection of the end panels 70 and side panels 74. These straps 126 wrap completely around the headboard or footboard 86 and may be tied together or otherwise connected to one another with VELCRO (hook and loop fasteners), snaps, buttons, or any other comparable fasteners. In one embodiment, as shown in FIGS. 14 and 15, the side panels 74 are not directly connected to the end panels 70. However, this embodiment has two sets of straps 126 at each end of the enclosure 50. One set is associated with the end panels 70 and one set is associated with the side panels 74. These sets of straps 126 are both wrapped around the headboard and footboard 86 and fastened together to eliminate any openings in the enclosure 50. In other embodiments, as shown in FIGS. 1, 2, and 9, no such straps 126 are used. The top edges of the side panels 74 are secured to the top bar of the side rails by multiple side rail straps 114. In the illustrated embodiment, there are five side rail straps 114 on each of the two side rails 82, although any number can be used. The side rail straps 114 are shown to include a VELCRO fastener (hook and loop material) although other types of fastener may be used. These side rail straps 114 are anchored to the reinforcing strip 142 which runs the length of the side panels adjacent to the top of the side rail 82 in the illustrated embodiment. In the preferred embodiment, this reinforced strip 142 is made of taffeta, although other materials may be used.

Figure 3:
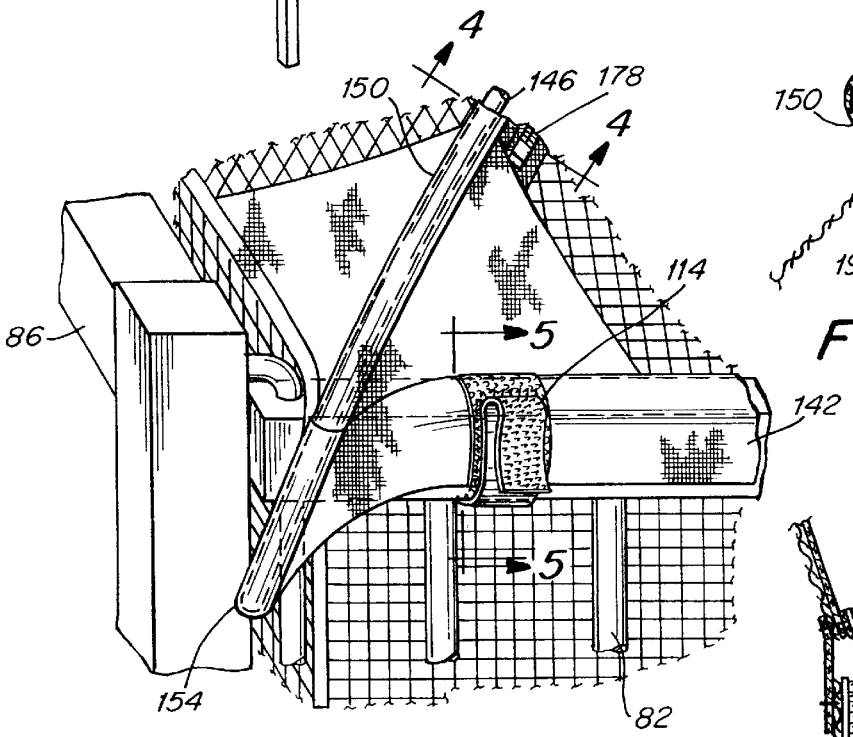
FIG. 3 is an enlarged perspective view of the front left comer of the protective enclosure assembled in a crib as viewed along sight line 3 in FIG. 2.

The top 66 of the enclosure 50 is comprised of a dome-shaped structure. The structure is supported by two semi-rigid ribs 146, each held firmly to the enclosure 50. In accordance with one embodiment of the invention, the ribs 146 are inserted into sleeves 150 of the enclosure 50 which end in pockets 154 near each corner of the top 66 as shown in FIG. 3. The pockets 154 at the corners of the enclosure 50 and the sleeves 150 hold the ribs 146 in a manner that causes them to bow into a desired shape. This bowed shape of the ribs 146 defines the dome-shaped structure of the top 66 of the enclosure 50. When the ribs 146 are removed from the sleeves 150, the enclosure will be unstructured and may be rolled or compressed for storage. While continuous sleeves 150 are shown in the preferred embodiment, multiple smaller sleeves, hooks or other fasteners may be used in place of the continuous sleeve.

A flap 174 is included in the dome shaped top 66 adjacent to one of the side panels 74. This flap 174 includes a zipper closure 178 in the illustrated embodiments, although other fasteners can be used. The flap 174 is generally shaped like an inverted 'U' with its closed zipper end 186 and open zipper end 190 terminating near and above the top of the side rails 82. The ends of the flap 174 are set at a height to help prevent a child from accessing the flap 174 or the zipper closure 178. The zipper 178 is arranged to open from right to left as the user is facing the covering from outside, thus placing the closed zipper end 186 on the right side. This arrangement is preferable because most adults prefer to operate the zipper 178 with their right arm while supporting the child with their left arm.

Figure 4:
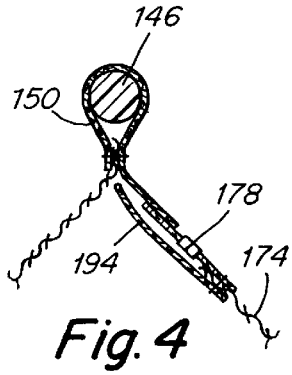
FIG. 4 is a cross-sectional view taken along section line 4—4 in FIG. 3 showing a zipper with a taut liner.
Figure 5:
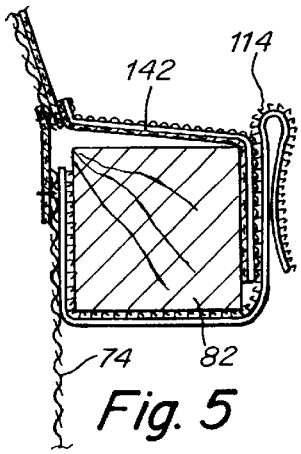
FIG. 5 is a cross sectional view taken along section line 5—5 in FIG. 3 showing a VELCRO-type (hooks and loop) strap connecting the enclosure to the side rail of the crib.

In some embodiments as shown in FIG. 4, there is a taut liner 194 on the interior of the flap 174 that further prevents a child from accessing the zipper 178 or the zipper mechanism 182 from the inside. This liner 194 is connected to the interior of the flap 174 on at least the lower side of the zipper 178. The uppermost side of the liner 194 is left free so that is does not interfere with the operation of the zipper 178. This arrangement makes it more difficult for a child to access the zipper mechanism 182 or zipper 178 as it requires the child to reach over the top edge of the liner 194 before gain access can be gained. This prevents the child from playing with the zipper mechanism 182 and injuring him or herself or from opening the zipper from the inside.

In some embodiments, as is shown in FIG. 8 there is a zipper pocket 198 located on the closed end 186 of the zipper 178. In the preferred embodiment, this is also the right hand side of the zipper. This pocket is made by attaching a lining material 130 on the interior side of the enclosure 50. The lining material 130 is sewn into the top of the enclosure around a portion of the periphery of the closed end of the zipper as shown by the stitches 134 in FIG. 8. The pocket provides a protective environment for the zipper mechanism 182 when it is positioned at the closed end 186 of the zipper 178. It prevents a child from reaching the zipper while the child is inside the enclosure, thus preventing the child from climbing out of the enclosure. The pocket extends a short distance 'D1' from the closed end 186 of the zipper 178 as shown in FIG. 6, while in other embodiments such as shown in FIG. 8, the pocket 198 extends a much greater length 'D2'. FIG. 7 depicts the cross section of the pocket when the zipper is closed. It is noted that the pocket as shown in FIG. 7 contains a certain amount of slack when the flap 174 is closed, although other embodiments may have more or less slack.

From the foregoing description those skilled in the art will appreciate that numerous modifications may be made of the preferred embodiment shown in the drawings without departing from the spirit of this invention. For instance, the dome-shaped top and the box-shaped bottom may be made as completely separable entities that are each independently attached to the crib. Therefore, it is not intended that the scope of the invention be limited to the specific embodiment illustrated, but rather its scope is to be determined by the appended claims and their equivalents.

What is claimed is:

1. An enclosure for use with a crib having a headboard, a footboard, a pair of side rails, a bottom support and a pad, the enclosure comprising:

a box-shaped body made of flexible mesh fabric having a bottom panel, a pair of side panels and a pair of end panels for fitting over the bottom support, and inside of the headboard, the footboard and the pair of side rails, wherein the crib provides structure to the box-shaped body;

a dome-shaped top having a structure provided by flexible mesh fabric and a plurality of bowed ribs for supporting the mesh fabric, wherein the dome-shaped top is attached to the pair of side panels, and the pair of end panels; and a flap disposed on the dome-shaped top adjacent to a side panel, the flap having a zipper with a zipper mechanism capable of moving between a closed end and an open end, the closed and the open end located above the side rails.

2. The enclosure of claim 1 wherein the end panels, the side panels and the bottom support are directly connected to one another at their adjacent edges.

3. The enclosure of claim 1 wherein each of the pair of end panels only have a direct connection to the dome-shaped top, and a pair of end panel straps connected to the end panels.

4. The enclosure of claim 3 further comprising an end panel strap attached to an end of each of the pair of side panels.

5. The enclosure of claim 1 further comprising a plurality of end panel straps for connecting the enclosure to the headboard and footboard of the crib.

6. The enclosure of claim 1 wherein the bottom panel extends under a margin of the pad and is open under the central portion of the pad.

7. The enclosure of claim 1 further comprising a pair of reinforcing strips located on the enclosure adjacent to each of the pair of side rails when the enclosure is assembled in a crib.

8. The enclosure of claim 7 wherein the pair of reinforcing strips are comprised of a taffeta material.

9. The enclosure of claim 1 further comprising a zipper pocket attached to the top for preventing access to the zipper mechanism from inside of the enclosure when the zipper mechanism is positioned at the closed end.

10. The enclosure of claim 9 wherein the zipper pocket is at least two inches in length.

11. The enclosure of claim 9 wherein the zipper pocket is at least six inches in length.

12. The enclosure of claim 1 further comprising a protective liner connected to the flap of the enclosure at a position inside of the enclosure, wherein the liner is positioned for preventing a child from accessing the zipper from inside of the enclosure.

13. The enclosure of claim 1 wherein the pair of end panels are comprised of a reinforcing material.

14. The enclosure of claim 13 wherein the reinforcing material is taffeta.

15. The enclosure of claim 1 wherein the flap comprises an inverted "U" shape.

16. An enclosure for use with a crib having a headboard, a footboard, a pair of side rails, a bottom support and a pad, the enclosure comprising:

a box-shaped body made of flexible mesh fabric having a bottom panel, a pair of side panels and a pair of end panels for fitting over the bottom support, and inside of the headboard, the footboard and the pair of side rails;

a dome-shaped top comprised of flexible mesh fabric and a plurality of bowed ribs, the dome-shaped top attached to the pair of side panels and the pair of end panels;

a flap disposed on the dome-shaped top adjacent to a side panel, the flap having a zipper with a zipper mechanism capable of moving between a closed end and an open end, the closed and the open ends located above the side rails; and a zipper pocket for preventing access to the zipper mechanism from inside of the enclosure when the zipper mechanism is positioned at the closed end.

17. The enclosure of claim 16 wherein the end panels, the side panels and the bottom support are directly connected to one another at their adjacent edges.

18. The enclosure of claim 16 wherein each of the pair of end panels only have a direct connection to the dome-shaped top and a pair of end panel straps.

19. The enclosure of claim 18 further comprising an end panel strap attached to an end of each of the pair of side panels.

20. The enclosure of claim 16 further comprising a plurality of end panel straps for connecting the enclosure to the headboard and footboard of the crib.

21. The enclosure of claim 16 wherein the bottom panel extends under a margin of the pad and is open under the central portion of the pad.

22. The enclosure of claim 16 further comprising a pair of reinforcing strips located on the enclosure adjacent to each of the pair of side rails when the enclosure is assembled in a crib.

23. The enclosure of claim 22 wherein the pair of reinforcing strips are comprised of a taffeta material.

24. The enclosure of claim 16 wherein the zipper pocket is at least two inches in length.

25. The enclosure of claim 16 wherein the zipper pocket is at least six inches in length.

26. The enclosure of claim 16 further comprising a protective liner connected to the flap of the enclosure at a position inside of the enclosure, wherein the liner is positioned for preventing a child from accessing the zipper from inside of the enclosure.

27. The enclosure of claim 16 wherein the pair of end panels are comprised of a reinforcing material.

28. The enclosure of claim 27 wherein the reinforcing material is taffeta.

29. The enclosure of claim 16 wherein the box-shaped body is unstructured.

30. An enclosure for use with a crib having a headboard, a footboard, a pair of side rails, a bottom support and a pad, the enclosure comprising:

a box-shaped body made of flexible mesh fabric having a bottom panel, a pair of side panels and a pair of end panels for fitting over the bottom support, and inside of the headboard, the footboard and the pair of side rails;

a dome-shaped top comprised of flexible mesh fabric and a plurality of ribs, the dome-shaped top attached to the pair of side panels and the pair of end panels, wherein each of the pair of end panels only have a direct connection to the dome shaped top and straps connected to the end panels; and a flap disposed on the dome-shaped top adjacent to a side panel, the flap having a zipper with a zipper mechanism capable of moving between a closed end and an open end for securing the flap to the top in a closed or open position, the closed and the open end located above the side rails.

31. The enclosure of claim 29 further comprising an end panel strap attached to an end of each of the pair of side panels.

32. The enclosure of claim 29 wherein the bottom panel extends under a margin of the pad and is open under the central portion of the pad.

33. The enclosure of claim 29 further comprising a pair of reinforcing strips located on the enclosure adjacent to each of the pair of side rails when the enclosure is assembled in a crib.

34. The enclosure of claim 32 wherein the pair of reinforcing strips are comprised of a taffeta material.

35. The enclosure of claim 30 further comprising a zipper pocket for preventing access to the zipper mechanism from inside of the enclosure when the zipper mechanism is positioned at the closed end.

36. The enclosure of claim 35 wherein the zipper pocket is at least two inches in length.

37. The enclosure of claim 35 wherein the zipper pocket is at least six inches in length.

38. The enclosure of claim 30 further comprising a protective liner connected to the flap of the enclosure at a position inside of the enclosure, wherein the liner is positioned for preventing a child from accessing the zipper mechanism from inside of the enclosure.

39. The enclosure of claim 30 wherein the pair of end panels are comprised of a reinforcing material.

40. The enclosure of claim 39 wherein the reinforcing material is taffeta.

41. The enclosure of claim 30 wherein the enclosure is unstructured.

* * * * *